US005575061A

United States Patent [19]

Tsuji et al.

[11] Patent Number: 5,575,061

[45] Date of Patent: Nov. 19, 1996

[54] WIRE PRESSING METHOD AND APPARATUS FOR PRESSING A WIRE INTO A TERMINAL

[75] Inventors: Masanori Tsuji; Hiroshi Yamamoto; Sakai Yagi, all of Shizuoka, Japan

[73] Assignee: Yazaki Corporation, Tokyo, Japan

[21] Appl. No.: 388,439

[22] Filed: Feb. 14, 1995

[30] Foreign Application Priority Data

Feb. 14, 1994 [JP] Japan ..... 6-017553
May 25, 1994 [JP] Japan ..... 6-111440

[51] Int. Cl.[6] ..... H01R 43/04

[52] U.S. Cl. ..... 29/863; 29/33 M; 29/748; 29/884

[58] Field of Search ..... 29/850, 863, 753, 29/884, 33 M, 748

[56] References Cited

U.S. PATENT DOCUMENTS 4,461,061 7/1989 Rock ..... 29/850 X
5,075,963 12/1991 Pawlenko .
5,355,582 10/1994 Saito et al. .

FOREIGN PATENT DOCUMENTS 61-136484 8/1986 Japan ..... H01R 43/01
62-82683 4/1987 Japan ..... H01R 43/01
64-9362 1/1989 Japan ..... H01R 4/24
448568 2/1992 Japan ..... H01R 43/00
433285 2/1992 Japan ..... H01R 43/00
433286 2/1992 Japan ..... H01R 43/01
4259775 9/1992 Japan ..... H01R 43/01
4355087 12/1992 Japan ..... H01R 43/048
536884 6/1993 Japan ..... H01B 13/00

*Primary Examiner*—Carl J. Arbes
*Attorney, Agent, or Firm*—Sughrue, Mion, Zinn, Macpeak & Seas

[57] ABSTRACT

A wire pressing method and apparatus for a pressure terminal using a pressing punch to connect a wire to pressing blades of the pressure terminal. The pressing punch has a pressing section for press-fitting the wire and is vertically movable. A pair of walls extending in a pressing direction are arranged on both sides of the pressing section, and the pressing blades of the pressure terminal are located between the walls at the time of a pressing operation. In this manner the wire is press-fitted into the pressing blades by the pressing section while both the walls are prevented by the pressing blades from expanding outwardly. The wire pressing method and apparatus can also be used to connect a wire to pressing blades of the pressure terminal when the terminal is received in a connector housing. This is done by retaining the side walls of the terminal receiving chamber such that the side walls will not expand outwardly during the pressing operation.

16 Claims, 8 Drawing Sheets

WIRE PRESSING METHOD AND APPARATUS FOR PRESSING A WIRE INTO A TERMINAL

BACKGROUND OF THE INVENTION

1. Field of the Invention

The invention relates to a wire pressing method and apparatus for connecting a sheathed wire to a pressure terminal by press-fitting the sheathed wire into the pressing blades of the pressure terminal.

2. Related art

Conventionally, a wire is crimped to a pressure terminal using a wire pressing apparatus by press-fitting a sheathed wire into plate-like pressing blades of the pressure terminal using a pressing punch, each pressing blade having a slot into which the wire is press-fitted. This press-fitting force causes the edges of the pressing blades to cut the sheathed portion of the wire to expose the conductors and establish electrical connection.

A conventional example in which a wire is pressed onto a pressure terminal before attaching the pressure terminal to a connector housing wall be described.

FIG. 11 illustrates method for connecting a wire 40 to a pressure terminal 33 using a wire pressing apparatus 100. The method includes the following steps: setting the pressure terminal 33 on a pedestal 21 by forwarding catenated terminals 30; placing an end portion of the wire 40 on a wire connecting part 36 of the pressure terminal 33; and then lowering an applicator 10 by driving an air cylinder 12 to press and fix a barrel part 35 of the terminal with a terminal press 15 and simultaneously lowering a pressing punch 102 and an insulator crimper 17.

As a result of this operation, a wire pressing groove 104 of pressing section 103 at the front end of the pressing punch 102 abuts against the wire 40, and the conductors of the wire 40 are press-fitted into the slots of pressing blades 38. As a result, the sheathed portion of the wire 40 is cut by the respective pressing blades 38 to thereby establish electrical connection of the conductors with the connector. In addition, the upper ends of the pressing blades 38 are received in releasing grooves 105 arranged in the pressing section 103 so as to prevent displacement of the pressing blades in the longitudinal direction. Thereafter, the outer sheathed portion is fixed by crimping pieces 36*a*, so that the wire pressing operation is completed.

Next, a conventional example in which a wire is crimped to a pressure terminal after the pressure terminal has been received in a connector housing will be described. This wire pressing operation includes two stages: the first stage involves the step of attaching the pressure terminal to the connector housing; and the second stage involves the step of connecting the wire to the pressure terminal.

The first step of attaching the pressure terminal to the housing is such that longitudinally catenated pressure terminals wound in a reel are sequentially inserted into terminal accommodating chambers from the rear end of the housing continuously and then the catenated pieces are separated, as disclosed in, e.g., Unexamined Japanese Patent Publication Hei. No. 4-33285.

The second step of attaching the pressure terminal to the wire which is received in the terminal accommodating chamber is disclosed in, e.g., Unexamined Japanese Patent Publication No. Hei. 4-48568 and Unexamined Japanese Utility Model Sho. 61-136484.

In more detail, as shown in FIG. 12, a pressure terminal 108 is inserted from the rear into the forward portion of housing 106. At this instance, since a downwardly projecting retaining lance (not shown) is provided at the front end portion of the pressure terminal 108, an appropriate clearance is provided in the upper part of the terminal accommodating chamber between adjacent cavity walls 122.

The pressure terminal 108 is fixed at a correct position by a positioning jig, and then the wire 40 is press-fitted into pressing blades 107 by the wire pressing apparatus 110 having the pressing punch 102 that is fixed on a vertically movable applicator main body 113 from above. At this instance, the sheathed portion of the wire 40 is cut by the edges of the pressing blades 107, so that electrical connection is established. It may be noted that the wire pressing groove 103 in which the sheathed portion of the wire is received and the releasing grooves 105 for avoiding interference with the pressing blades 107 are formed in the front end of the pressing punch 102.

However, with reference to FIG. 13, the following problems are encountered when a wire is crimped onto a pressure terminal before attaching the pressure terminal to the housing. If the sheathed portion of the wire 40 is thick or the sheathing material rigid, or if the pressing blades 38 do not perform the cutting function satisfactorily, then the wire pressing groove 104 is abutted against the wire 40 by the lowering of the pressing section 103 of the pressing punch 102, thereby press-fitting the wire 40 into the slots 39, and as a result of the press-fitting operation, expanding force P is applied to the pressing blades 38, thereby causing a pair of confronting pieces 38*a* constituting the slot 39 of each pressing blade 38 to be expanded outwardly.

As the confronting pieces 38*a* are further expanded, the pressing blades 38 are plastically deformed, which in turn reduces or eliminates the pressing force applied to the wire 40 by the pressing blades 38. That is, once the pressure terminal 33 has been plastically deformed beyond the limit of elastic deformation, it is likely that electrical conduction between the wire 40 and the pressing blades 38 will not be established. Further, even within the limit of elastic deformation, it becomes difficult to attach the pressure terminal 33 to the housing if a width W between the pressing blades 38 in the expanded condition is larger than the width between cavity walls (not shown) of the housing.

As described above, the pressing blades 38 are likely to be expanded in the conventional wire pressing apparatus, and this may lead to inconvenience in that the expanded pressing blades 38 cause side walls 37 to incline outward or that, in some cases, it becomes difficult to insert the pressure terminal 33 into the housing.

With reference to FIG. 14, the problems encountered when the wire is pressure crimped to a pressure terminal after having attached the pressure terminal to the housing are as follows. By way of example, if the sheath of the wire 40 is thick or the sheathing material is rigid, or if the pressing blades 107 do not perform the cutting function satisfactorily, then the side portions of the pressing blades 107 are expanded toward the cavity walls 122 of the housing 106 as the wire 40 is press-fitted by the lowering of the pressing punch 102. In addition, once the pressing blades 107 have been plastically deformed and have therefore lost restitutive force by going beyond the limit of elastic deformation, necessary contact cannot be provided, which in turn makes it unlikely that a connection providing electrical conduction between the conductors of the wire 40 and the pressing blades 107 will be implemented.

Still further, since the expanded pressing blades 107 cause the cavity walls 122 of the housing to incline, cavities adjacent thereto are affected, or, in some cases, it is likely that the pressure terminal cannot be connected to the wire by pressure.

Therefore, for the aforementioned reasons, problems such as a reduction in the yield of a mass production process, a curtailed designing freedom due to a restricted use of materials, and an increase in the cost of manufacture are encountered.

The invention has been made to overcome the aforementioned problems. Accordingly, the object of the invention is to provide a wire pressing method and apparatus for a pressure terminal which is capable of connection of a wire by not only allowing electrical conduction to be established between pressure terminals and wires of differing standards, but also preventing pressing blades from being expanded at the time of a pressing operation.

SUMMARY OF THE INVENTION

The above object of the invention can be achieved by a wire pressing method for a pressure terminal using a pressing punch to connect a wire to pressing blades of the pressure terminal, the pressing punch having a pressing section for press-fitting the wire and being vertically movable, wherein a pair of walls extending in a pressing direction are arranged on both sides of the pressing section, and the pressing blades of the pressure terminal are located between the walls at the time of a pressing operation, so that the wire is press-fitted into the pressing blades by the pressing section while causing both the walls to prevent the pressing blades from being expanded.

The above object of the invention can also be achieved by a wire pressing method for a pressure terminal using a pressing punch to connect a wire to pressing blades of the pressure terminal attached to a connector housing, the pressing punch having a pressing section for press-fitting the wire and being vertically movable, wherein a pair of walls extending in a pressing direction are arranged on both sides of the pressing section, and cavity walls of the connector housing are located between the walls at the time of a pressing operation, the connector housing having the pressure terminal attached thereto, so that the wire is press-fitted into the pressing blades by the pressing section while causing both the walls to prevent the cavity walls from falling down.

The above object of the invention can also be achieved by a wire pressing method for a pressure terminal using a pressing punch to connect a wire to pressing blades of the pressure terminal attached to a connector housing, the pressing punch having a pressing section for press-fitting the wire and being vertically movable, wherein the wire is press-fitted into the pressing blades by the pressing punch while engaging a pair of movable holding sections with upper ends of cavity walls of the connector housing in association with lowering of the pressing punch and thereby preventing the cavity walls from falling down at the time of a pressing operation, the movable holding sections being arranged along both side surfaces of the pressing punch and urged downward by resilient members, one end of each resilient member being supported.

The above object of the invention can also be achieved by a wire pressing apparatus for a pressure terminal using a pressing punch to connect a wire to pressing blades of the pressure terminal, the pressing punch having a pressing section for press-fitting the wire and being vertically movable, wherein a pair of walls for preventing the pressing blades from being expanded are arranged on both sides of the pressing section so as to extend in a pressing direction, and a width between the walls is set to a value substantially equal to a width of the pressure terminal.

The above object can be achieved more effectively by forming guide surfaces for positioning the pressure terminal at front end portions of the walls of the pressing punch.

The above object of the invention can also be achieved by a wire pressing apparatus for a pressure terminal using a pressing punch to connect a wire to pressing blades of the pressure terminal attached to a connector housing, the pressing punch having a pressing section for press-fitting the wire and being vertically movable, wherein a pair of walls for preventing cavity walls of the connector housing from falling down are arranged on both sides of the pressing section so as to extend in a pressing direction, and a width between the walls is set to a value substantially equal to a width between the cavity walls positioned on both sides of the pressure terminal.

The above object of the invention can be achieved more effectively by forming guide surfaces for positioning the connector housing at front end portions of the walls of the pressing punch.

The above object of the invention can also be achieved by a wire pressing apparatus for a pressure terminal using a pressing punch to connect the wire to pressing blades of the pressure terminal attached to a connector housing, the pressing punch having a pressing section for press-fitting the wire and being vertically movable, wherein a pair of movable holding sections are arranged, the pair of movable holding sections being disposed along both side surfaces of the pressing punch, urged downward by resilient members, and having engaging grooves in lower ends thereof, one end of each resilient member being supported, and the engaging grooves serving to engage upper ends of cavity walls of the connector housing at the time of a pressing operation.

The above object of the invention can be achieved more effectively by forming the pressing punch into an integrated releasable module.

The wire pressing method for a pressure terminal of the invention is characterized as arranging a pair of walls extending in a pressing direction on both sides of the pressing section, and locating the pressing blades of the pressure terminal between the walls at the time of a pressing operation, so that the wire is press-fitted into the pressing blades by the pressing section while causing both the walls to prevent the pressing blades from being expanded.

Therefore, the inner surfaces of both the walls are lowered during the pressing operation so as to be abutted against or in close proximity to the side walls of the pressure terminal, which in turn makes it unlikely that the pressing blades and the side walls of the pressure terminal will be expanded outward until the wire is completely press-fitted into the pressing blades of the pressure terminal by the pressing section.

The wire pressing method for a pressure terminal of the invention is also characterized as arranging a pair of walls extending in a pressing direction on both sides of the pressing section, and locating cavity walls of the connector housing having the pressure terminal attached thereto between the walls at the time of a pressing operation, so that the wire is press-fitted into the pressing blades by the pressing section while causing both the walls to prevent the cavity walls from falling down.

Therefore, the inner surfaces of both the walls are lowered during the pressing operation so as to be abutted against or in close proximity to the cavity walls on both sides of the pressure terminal attached to the housing, which in turn makes it unlikely that the cavity walls will fall down outward. Hence, the cavity walls prevent the pressing blades and the side walls of the pressure terminal from being expanded until the wire is completely press-fitted into the pressing blades of the pressure terminal by the pressing section.

The wire pressing method for a pressure terminal of the invention is also characterized by press-fitting the wire into the pressing blades by the pressing punch while engaging a pair of movable holding sections with upper ends of cavity walls of the connector housing in association with lowering of the pressing punch and thereby preventing the cavity walls from falling down at the time of a pressing operation, the movable holding sections being arranged along both side surfaces of the pressing punch and urged downward by resilient members, one end of each resilient member being supported.

Therefore, not only the lower ends of the movable holding sections are fitted with the upper ends of the cavity walls in association with the lowering of the pressing punch, but also the falling down of the cavity walls can be prevented by the urging force of the resilient members in association with the lowering of the pressing punch during the pressing operation. Hence, the cavity walls prevent the pressing blades and the side walls of the pressure terminal from being expanded until the wire is completely press-fitted into the pressing blades of the pressure terminal by the pressing punch.

The wire pressing apparatus for a pressure terminal of the invention is also characterized as arranging a pair of walls for preventing the pressing blades from being expanded on both sides of the pressing section so as to extend in a pressing direction, and setting a width between the walls to a value substantially equal to a width of the pressure terminal. The wire pressing apparatus of the invention is further characterized as forming guide surfaces for positioning the pressure terminal at front end portions of the walls of the pressing punch.

Therefore, the guide surfaces interpose the pressing blades and the side walls of the pressure terminal therebetween while positioning the pressure terminal during the pressing operation, which in turn prevents outward expansion of the pressing blades and the side walls which is caused at the time of press-fitting the wire.

The wire pressing apparatus for a pressure terminal of the invention is also characterized as arranging a pair of walls for preventing cavity walls of the connector housing from falling down on both sides of the pressing section so as to extend in a pressing direction, and setting a width between the walls to a value substantially equal to a width between the cavity wails positioned on both sides of the pressure terminal. In addition, guide surfaces for positioning the connector housing are formed at front end portions of the walls of the pressing punch.

Therefore, the guide surfaces interpose the cavity walls on both sides of the pressure terminal therebetween while positioning the housing during the pressing operation, which in turn prevents the cavity walls from falling down outward. Hence, outward expansion of the pressing blades and the side walls of the pressure terminal which is caused at the time of press-fitting the wire can be prevented by the cavity walls.

The wire pressing apparatus for a pressure terminal of the invention is also characterized as arranging a pair of movable holding sections, which are disposed along both side surfaces of the pressing punch and urged downward by resilient members and which have engaging grooves in lower ends thereof, one end of each resilient member being supported and the engaging grooves serving to engage upper ends of cavity walls of the connector housing at the time of a pressing operation.

Therefore, not only the engaging grooves in the lower ends of the movable holding sections are fitted with the upper ends of the cavity walls, but also the falling down of the cavity walls can be prevented by the urging force of the resilient members in association with the lowering of the pressing punch during the pressing operation. Hence, outward expansion of the pressing blades and the side walls of the pressure terminal which is caused at the time of press-fitting the wire can be prevented by the cavity walls.

Still further, by forming a pressing punch into an integrated releasable module, a plurality of pressing punches can be interchangeably used so as to correspond to housings and pressure terminals of differing type.

DETAILED DESCRIPTION OF THE INVENTION

Figure 1:
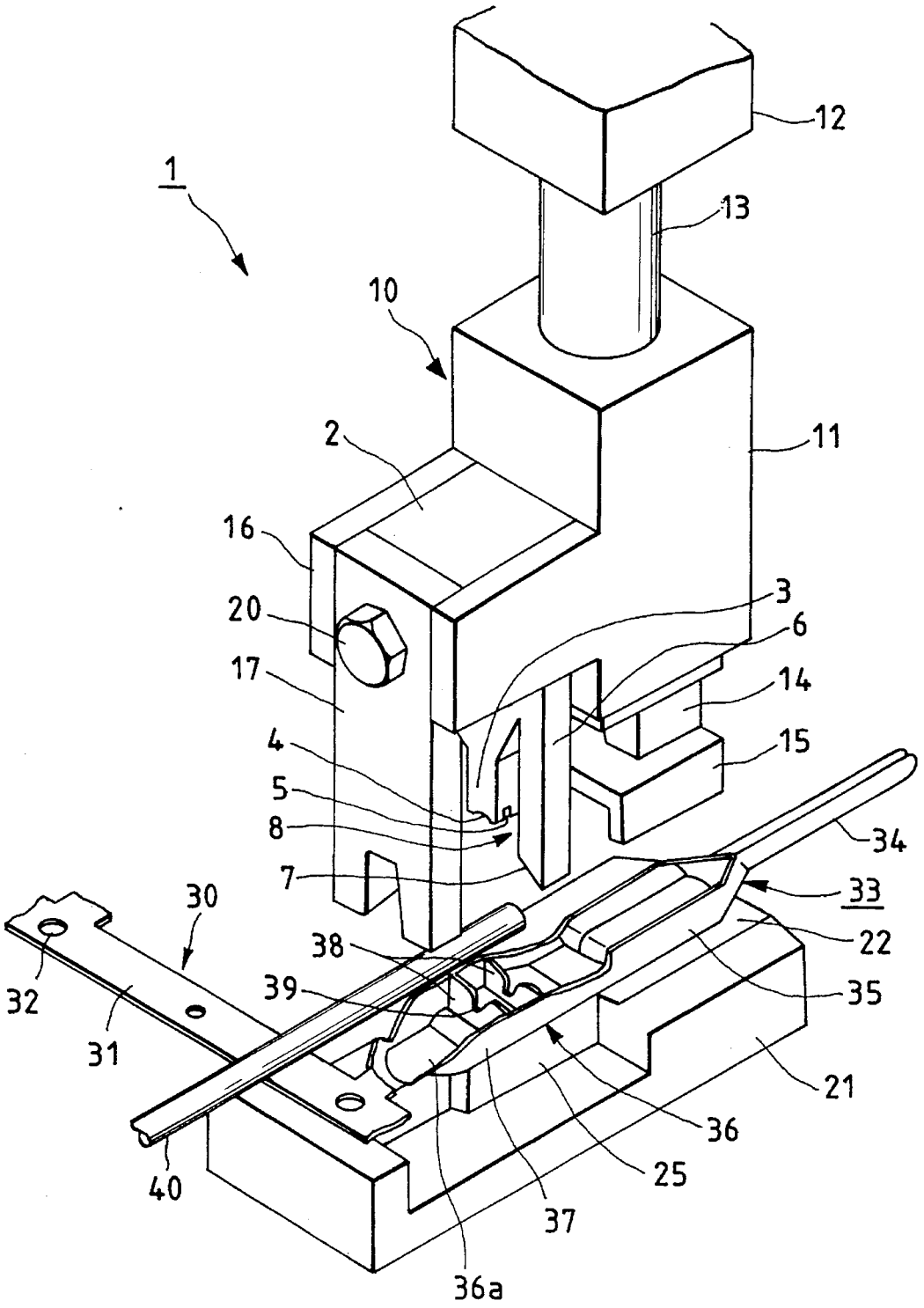
FIG. 1 is a perspective view showing a wire pressing apparatus for a pressure terminal, which is a first embodiment of the invention.
Figure 2:
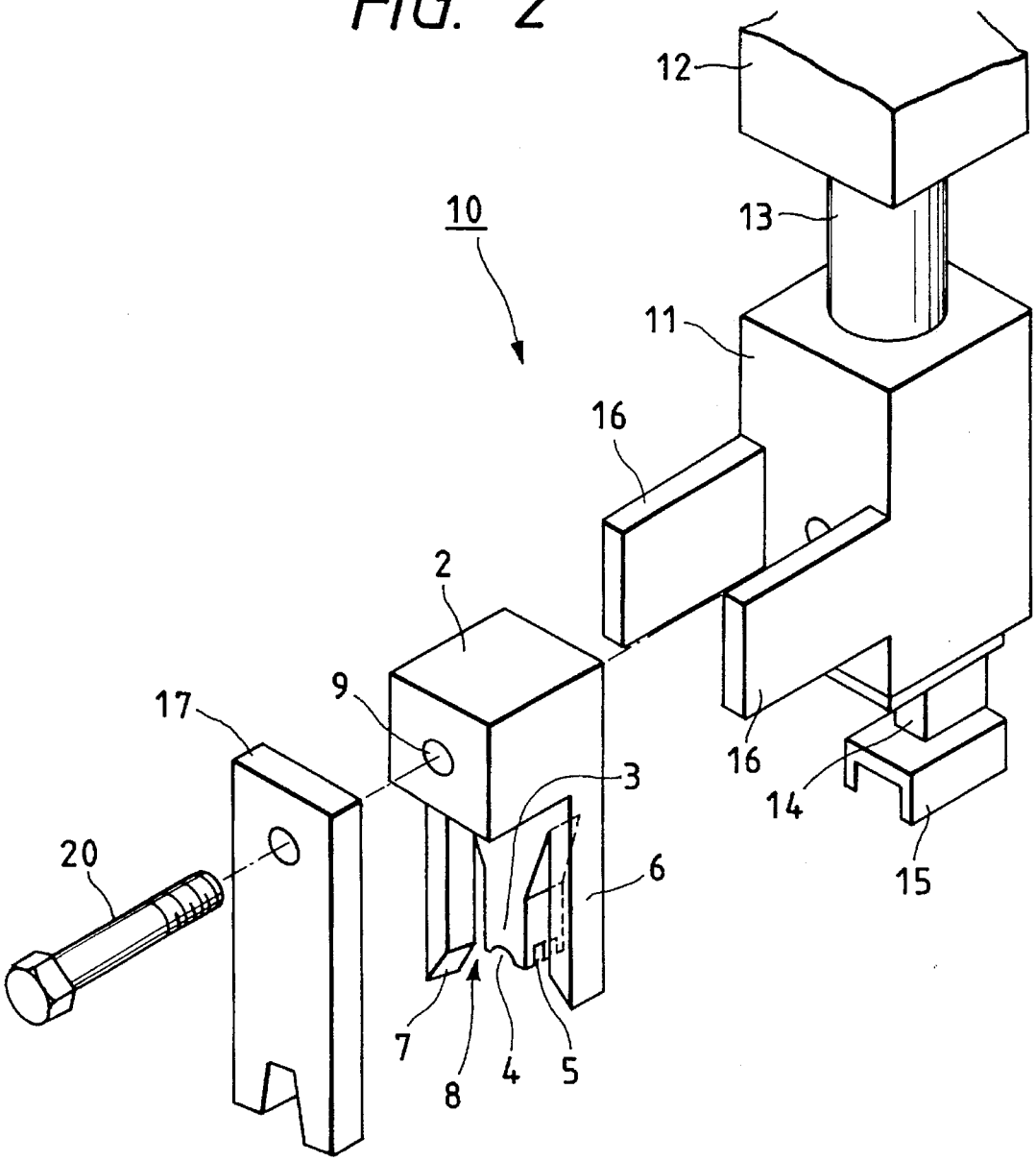
FIG. 2 is an exploded perspective view of a pressing punch and surrounding parts thereof in FIG. 1.
Figure 4:
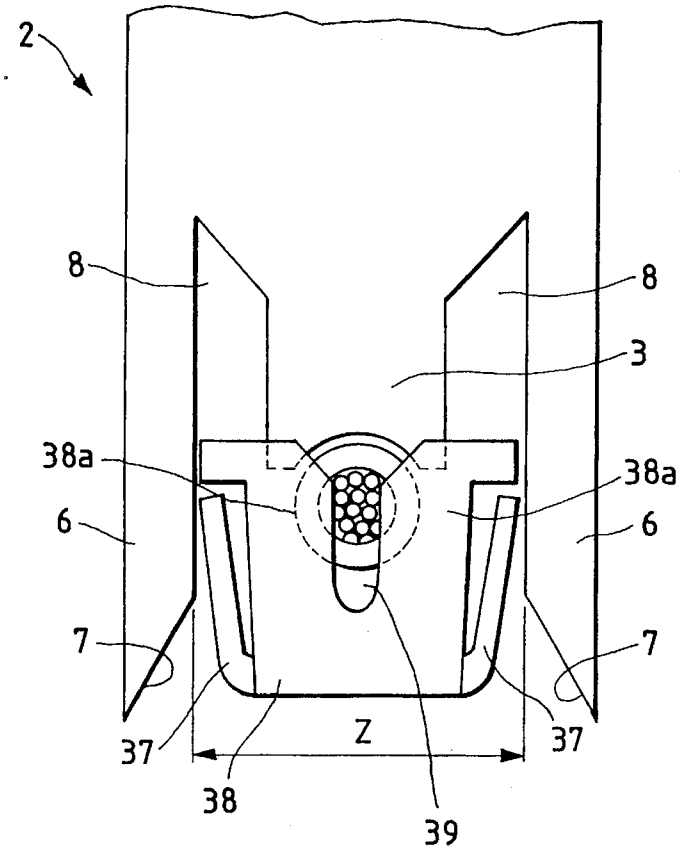
FIG. 4 is a diagram illustrative of an operation of the pressing punch shown in FIG. 1 in the form of a condition after having pressed the wire.
Figure 3:
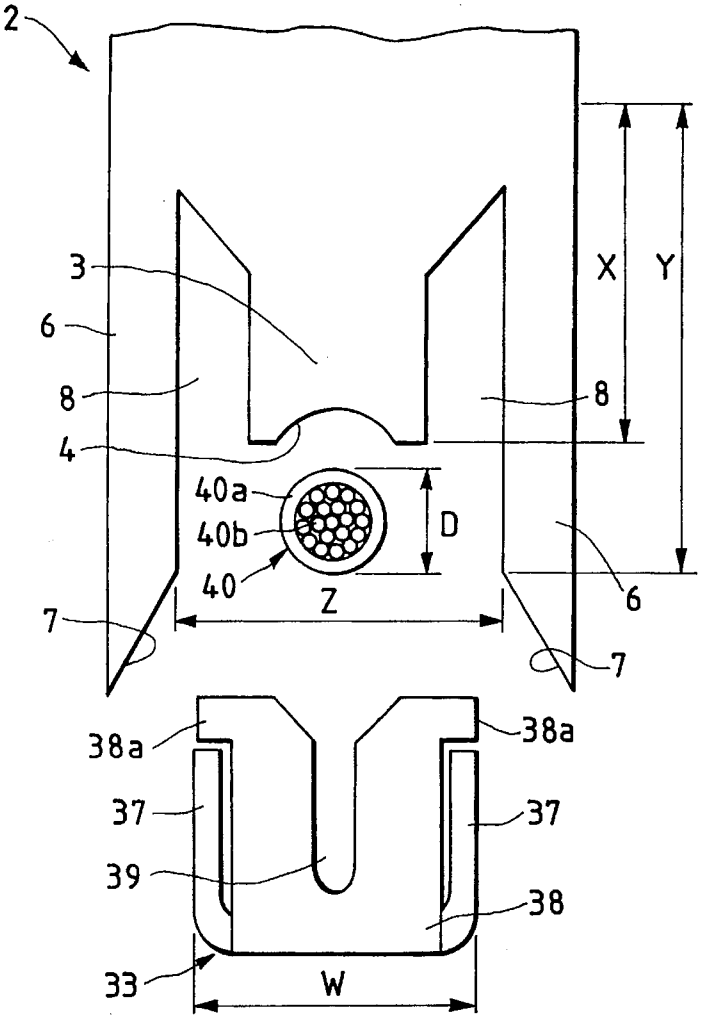
FIG. 3 is a diagram illustrative of an operation of the pressing punch shown in FIG. 1 in the form of a condition before pressing a wire.

A first embodiment of the invention will now be described in detail with reference to FIGS. 1 to 4. FIG. 1 is a perspective view showing a wire pressing apparatus for a pressure terminal, which is a first embodiment of the invention; FIG. 2 is an exploded perspective view of a pressing punch and surrounding parts of FIG. 1; FIG. 3 is a diagram illustrative of an operation of the pressing punch shown in FIG. 1 in the form of a condition before pressing a wire; and FIG. 4 is a diagram illustrative of an operation of the pressing punch shown in FIG. 1 in the form of a condition after having pressed the wire. It may be noted that the application of the invention is not, of course, limited to embodiments to be described below, that like parts and components are denoted by the same reference numerals, and that the descriptions thereof will therefore be omitted.

As shown in FIG. 1, a wire pressing apparatus according to the first embodiment chiefly includes a vertically movable applicator 10, and a pedestal 21 that carries a pressure terminal 33 thereon. The pedestal, confronting the applicator 10, has a wide seat 22 for accommodating an electric contact part 34 and a barrel part 35 of the pressure terminal 33 on one end and a seat 25 for accommodating a wire connecting part 36 on the other.

The applicator 10 includes a vertically movable applicator main body 11 that is screwed into a piston rod 13 of an air cylinder 12; a pressing punch 2 fixed by a bolt 20 between side plates 16, 16 on the front of the applicator main body 11; an insulator crimper 17 for crimping a wire 40; and a terminal press 15 disposed at the lower surfaces of the applicator main body 11 through a column.

The pressing punch 2 has a pressing section 3 that has a wire pressing groove 4 and releasing grooves 5 for pressing blades 38 in the lower end surface thereof and a pair of walls 6, 6 extending downward with interposing grooves 8 therebetween. The inner surfaces of the walls 6, 6 are formed into tapered guide surfaces 7.

A male pressure terminal 33 is exemplified in this embodiment. This pressure terminal 33 has the electric contact part 34 at the tip thereof, the wire connecting part 36 at the rear end thereof, and the barrel part 35 at the intermediate portion thereof formed continuously. The wire connecting part 36 includes: side walls 37 on both sides thereof; a pair of pressing blades 38, 38, each being formed by cutting part of the connecting part of the terminal and raising the cut part between the side walls 37, 37 and having a slot; and crimping pieces 36*a* for crimping the sheathed portion of a wire. Further, the barrel part 35 serves not only as a longitudinally long pressure terminal 33 reinforcing portion but also as a retaining portion for assisting in retaining the terminal within a terminal accommodating chamber inside a housing. It may be noted that catenated terminals 30 are formed by projecting a plurality of pressure terminals 33 from one side edge of a long catenated band 31 at a predetermined interval and that forwarding holes 32 that are engaged with a forwarding mechanism (not shown) are pitched at an equal interval in the catenated band 31.

As shown in FIG. 2, the applicator 10 is so constructed that the pressing punch 2 and the insulator crimper 17 are fixed by the bolt 20 between the side plates 16, 16 on the front of the applicator main body 11. The pressing punch 2 has a narrow pressing section 3 at the lower end portion of the plate-like main body thereof having a bolt hole 9. Not only the wire pressing groove 4 but also the releasing grooves 5 for the pair of pressing blades 38 are arranged in the lower end surface of the pressing section 3.

In addition, on both sides of the pressing section 3 are the walls 6, 6 that extend downward with grooves 8 being disposed between the walls and the pressing section. Each wall 6 has such a rigidity as to resist an expanding force in order to prevent the side walls 37 from being expanded outwardly as discussed above in regard to the conventional arrangement so that the side walls will not abut against the outside surfaces of the adjacent side walls. Moreover, the inner side surface at the front end of each wall 6 is formed into the tapered guide surface 7 for positioning the pressure terminal 33.

As shown in FIG. 3, the size of the pressing punch 2 is such that the length Y of the wall 6 excluding the guide surface 7 portion is set to a value larger than the sum of the outer diameter D of the wire 40 and the length X of the pressing section 3. Further, the width Z between both walls 6, 6 is set within an allowable deformation range of the pressing blades 38; i.e., the width Z is smaller than the cavity width of the not shown housing and equal to or slightly larger than the width W of the pressure terminal 33.

These dimensions can prevent the expansion of the outer sides of the side walls 37 of the pressure terminal 33 by causing the wire 40 to be abutted against or in close proximity to the outer sides of the side walls 37 even before the wire 40 is press-fitted into the pressing blades 38. Therefore, there is no likelihood that the pressure terminal 33, expanded within the allowable range at the time of pressing, will be inserted into the cavity of the housing.

Still further, the pressing punch 2 is formed into a module with the pressing section 3 and the side walls 6, 6 integrally contained therein, and this allows pressing punches corresponding to specifications of differing standard to be prepared. As a result of this construction, a plurality of types of pressing punches can be used interchangeably on a single wire pressing apparatus, thereby allowing pressure terminals of differing size and specification to be connected by pressure. Hence, not only superfluous equipment investment but also the cost of manufacture can be curtailed.

That is, the wire pressing apparatus for a pressure terminal of the invention comprises a pair of walls 6, 6 on both sides of the pressing section 3 of the pressing punch 2, the pair of walls 6, 6 serving to prevent the pressing blades 38 of the pressure terminal 33 from being opened apart from each other; guide surfaces 7 for positioning the pressure terminal 33 on the inner surfaces of the front ends of the walls 6; thereby integrating both the pressing section 3 and the walls 6 into a module, A method of pressing a wire onto a pressure terminal will be described next. First, as shown in FIG. 1, the pressing punch 2 is attached to the vertically movable applicator main body 11 of the wire pressing apparatus, the pressing punch 2 having the walls 6, 6 disposed on both side surfaces of the pressing section 3 thereof. That is, prior to starting the pressing operation, the applicator main body 11 is in a stand-by position above the wire 40 and the pressure terminal 33 together with the pressing punch 2.

Then, as shown in FIG. 3, the pressure terminal 33 is set on the pedestal 21, and an end portion of the wire 40 is placed on the wire connecting part 36 of the pressure terminal 33. It is under this condition that the wire pressing operation is started; i.e., the applicator 10 is lowered by the driving of the air cylinder 12. As a result, the wire pressing groove 4 in the lower end of the pressing section 3 is abutted against a sheathed portion 40*a* of the wire 40 so that the wire 40 is pressed down.

This in turn causes the lower portion of the sheathed portion 40*a* of the wire 40 to be abutted against the pressing blades 38. At this instance, the inner surfaces of the walls 6, 6 arranged on both side surfaces of the pressing section 3 are abutted against both side walls 37, 37 of the pressing section 3.

When the applicator 10 is further lowered as shown in FIG. 4, the edges of the pressing blades 38, which define the slots 39, cut and open the sheathed portion of the wire 40. Since the releasing grooves 5 of the pressing section 3 are fitted with the upper edges of the pressing blades 38 at this instance, there is no likelihood that the lower end of the pressing section 3 will interfere with the upper ends of the pressing blades 38 in association with the press-fitting of the wire 40. When the wire 40 has been press-fitted into the slot 39 of each pressing blade 38, outwardly expanding force is applied to confronting pieces 38*a*, 38*a* of each pressing blade 38 and both side walls 37, 37.

However, both walls 6, 6 of the pressing punch 2 are so structured as not to be displaced outwardly, and in addition both walls 6, 6 of the pressing punch 2 are lowered further down with respect to the pressing blades 38 and the upper ends of both side walls 37, 37 before the wire 40 is abutted against the pressing blades 38 during the pressing operation.

As a result, even if the expanding force is applied to the confronting pieces 38*a*, 38*a* of each pressing blade 38 during the pressing operation, both walls 6, 6 prevent the pressing blades 38 and both side walls 37, 37 from being deformed by the expanding force.

Hence, excessive displacement of the confronting pieces 38*a*, 38*a* on both sides of each pressing blade 38 and of both side walls 37, 37 due to their being expanded in the outward direction can be avoided reliably. That is, there will be no such deformation as to expand the pressing blades 38 and both side walls 37, 37 to a width larger than the width z between both walls 6, 6. Accordingly, stable electric conduction can be maintained reliably with the exposed conductors of the wire 40 being received in the slots 39 of the pressing blades 38.

Figure 5:
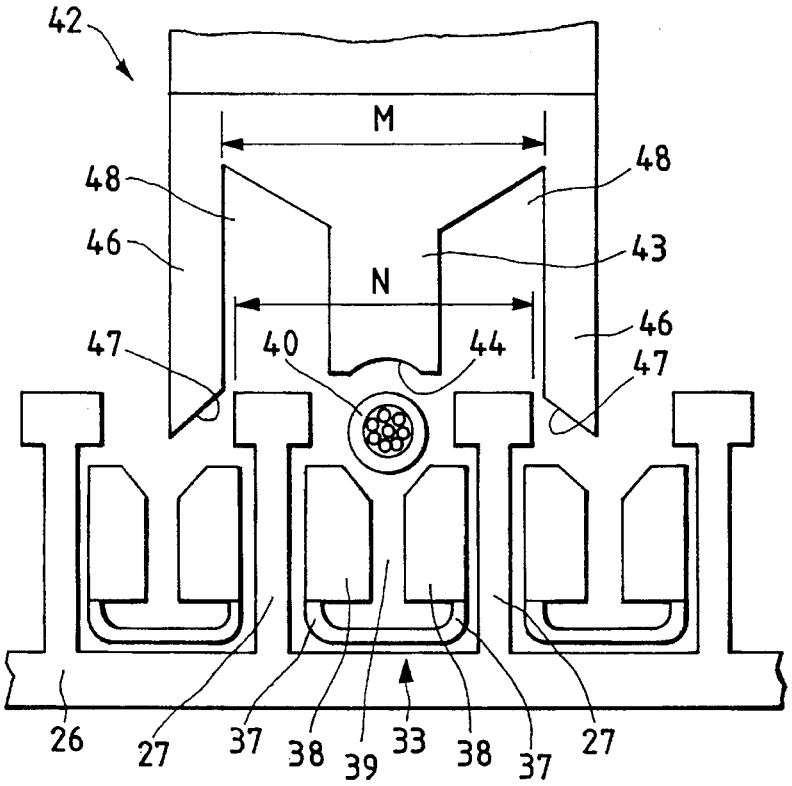
FIG. 5 is a diagram illustrative of an operation of a wire pressing apparatus for a pressure terminal, which is a second embodiment of the invention, in the form of a condition before pressing a wire.
Figure 6:
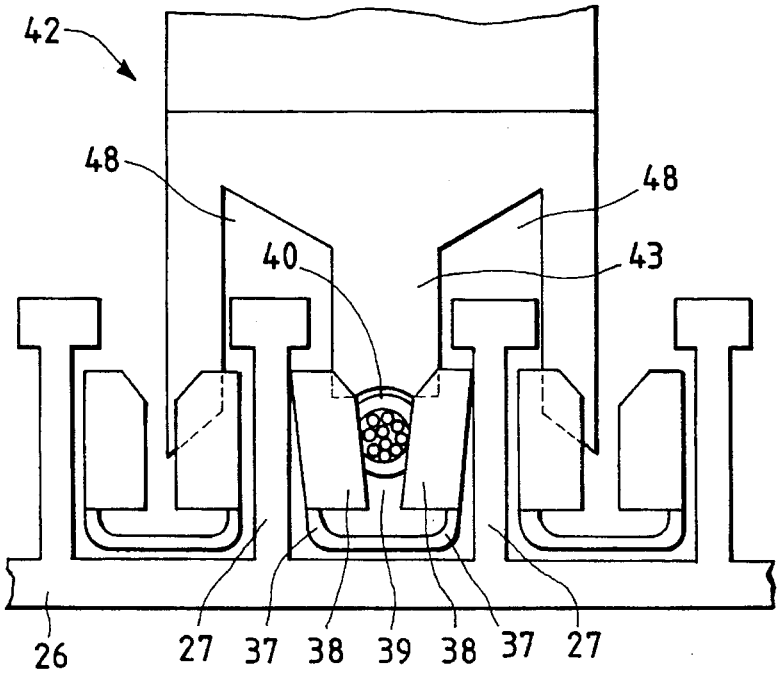
FIG. 6 is a diagram illustrative of an operation of the wire pressing apparatus shown in FIG. 5 in the form of a condition after having pressed the wire.

A second embodiment of the invention wall be described in detail next with reference to FIGS. 5 and 6. FIG. 5 is a diagram illustrative of an operation of a wire pressing apparatus for a pressure terminal, which is a second embodiment of the invention, in the form of a condition before pressing a wire; and FIG. 6 is a diagram illustrative of an operation of the wire pressing apparatus shown in FIG. 5 in the form of a condition after having pressed the wire.

While a pressing punch 42 has a construction similar to that of the pressing punch 2 according to the first embodiment as shown in FIG. 5, the pressing punch 42 is distinguished therefrom in that the pressure terminal 33 is attached to a housing 26 first and the wire 40 is pressed into the pressing blades 38 thereafter. In addition, the portions of a pair of walls 46, 46 of the second embodiment which are abutted against the cavity walls 27 of the housing 26 are different from those of the first embodiment.

The vertically movable pressing punch 42 includes a pressing section 43 for press-fitting a wire and a pair of walls 46, 46 extending in the pressing direction of the side surfaces of the pressing section 43 and having tapered guide surfaces 47 for positioning the housing 26 at the front ends thereof. These walls 46, 46 are provided to prevent the cavity walls 27 of the housing 26 from expanding outwardly. The inner side surfaces of the walls 46, 46 are abutted against or in close proximity to the cavity walls 27, 27 so as to interpose the outer side surfaces of the cavity walls 27, 27 as the pressing operation progresses. Therefore, the width M between the walls 46, 46 is set to a value substantially equal to or slightly larger than the width N between the cavity walls 27, 27 positioned on both sides of the pressure terminal 33. It may be noted that the downward lengths of the pressing section 43 and the walls 46 correspond to the first embodiment and that the description thereof is therefore omitted.

The operation of pressing the wire 40 onto the pressure terminal 33 will be described next. The pressure terminal 33 is inserted into the cavity of the housing 26 in which a plurality of terminal accommodating chambers are formed by juxtaposing a plurality of cavity walls 27, and the wire 40 is set above the pressure terminal 33.

Then, as shown in FIG. 6, when the pressing punch 42 is lowered, the inner side surfaces of the walls 46, 46 are abutted against or in close proximity to the cavity walls so as to interpose both cavity walls 27, 27 on both sides of the pressure terminal from outside while positioning the housing 26 with the guide surfaces 47 thereof. As the pressing punch 42 is further lowered, the wire pressing groove 44 in the front end of the pressing section 43 is abutted against the wire 40, causing the wire 40 to be press-fitted into the slots 39 between the pressing blades 38, 38.

At this instance, outwardly expanding force is applied to the pressing blades 38, 38 and the side walls 37, 37, causing the pressing blades 38, 38 and the side walls 37, 37 to be abutted against both cavity walls 27, 27. However, since the walls 46, 46 abut against the outside surfaces of the cavity walls 27, 27, the cavity walls 27, 27 will not be deflected outwardly.

Therefore, the expansion of the pressing blades 38 and the side walls 37 of the pressure terminal 33 is prevented until the wire 40 is completely press-fitted into the pressing blades 38 of the pressure terminal 33 by the pressing section 43. Thereafter, the pressing punch 42 is raised to make the wire pressing apparatus ready for pressing a next pressure terminal, and the current operation of pressing the wire 40 onto the pressure terminal 33 is completed.

It may be noted that the pressing punch 42 is formed into a module with the pressing section 43 and the walls 46, 46 integrally contained therein, and this allows pressing punches corresponding to specifications of differing standard to be prepared. As a result of this construction, a plurality of types of pressing punches can be used interchangeably on a single wire pressing apparatus, thereby allowing pressure terminals of differing size and specification to be connected by pressure.

Figure 8:
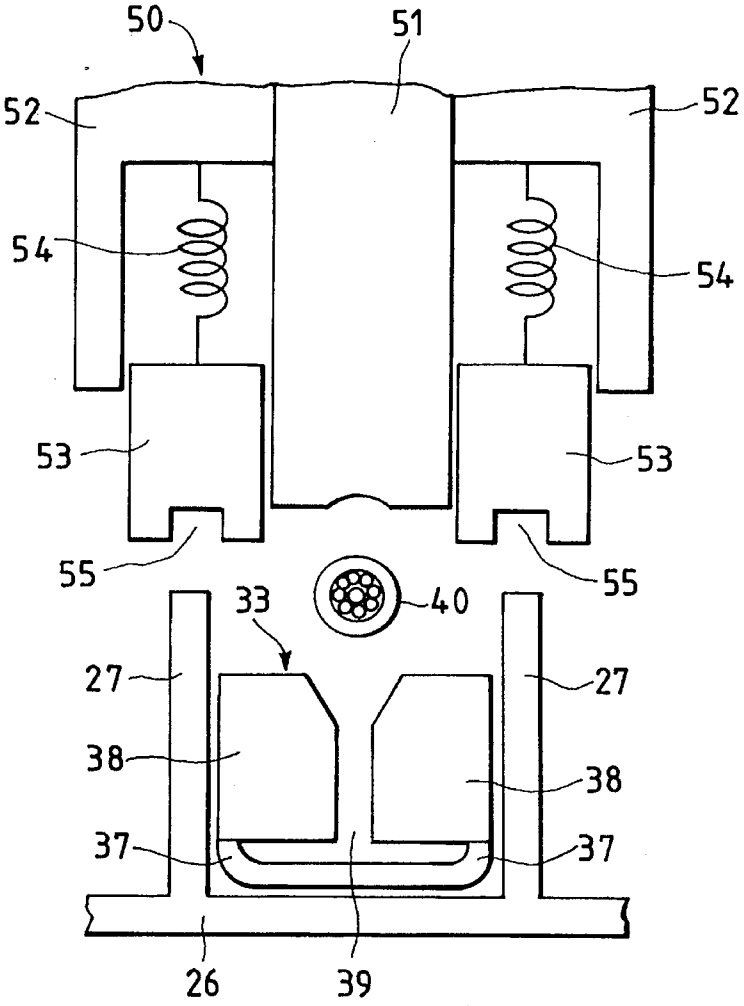
FIG. 8 is a diagram illustrative of an operation of the wire pressing apparatus shown in FIG. 7 in the form of a condition before pressing a wire.
Figure 7:
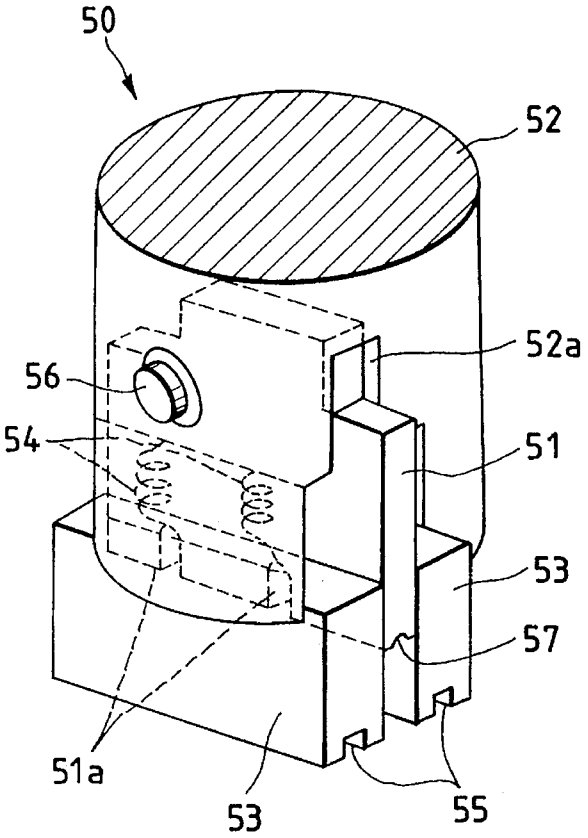
FIG. 7 is a partial perspective view of a main portion of a wire pressing apparatus for a pressure terminal, which is a third embodiment of the invention.
Figure 10:
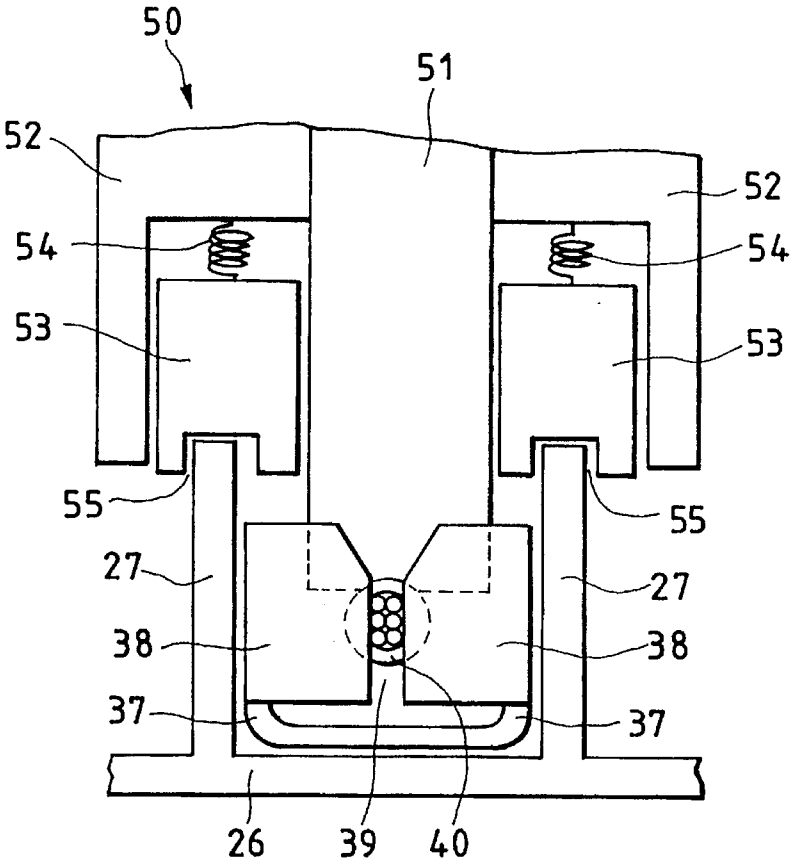
FIG. 10 is a diagram illustrative of an operation of the wire pressing apparatus shown in FIG. 7 in the form of a condition after having pressed the wire.
Figure 9:
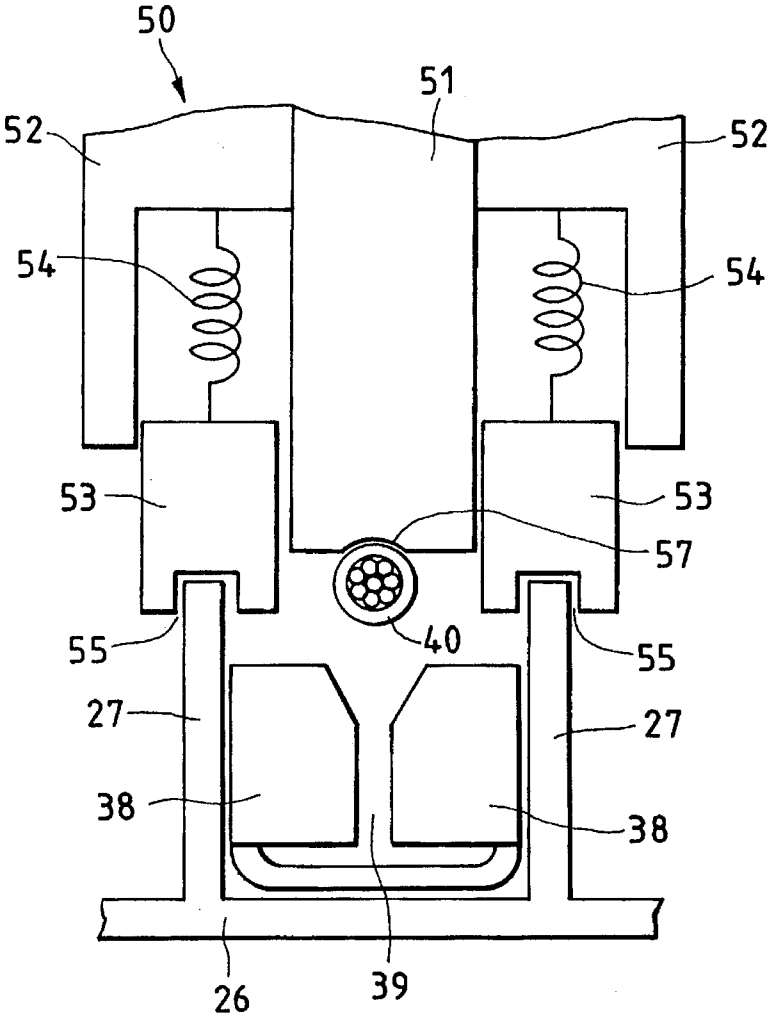
FIG. 9 is a diagram illustrative of an operation of the wire pressing apparatus shown in FIG. 7 in the form of a condition during the pressing of the wire.
Figure 11:
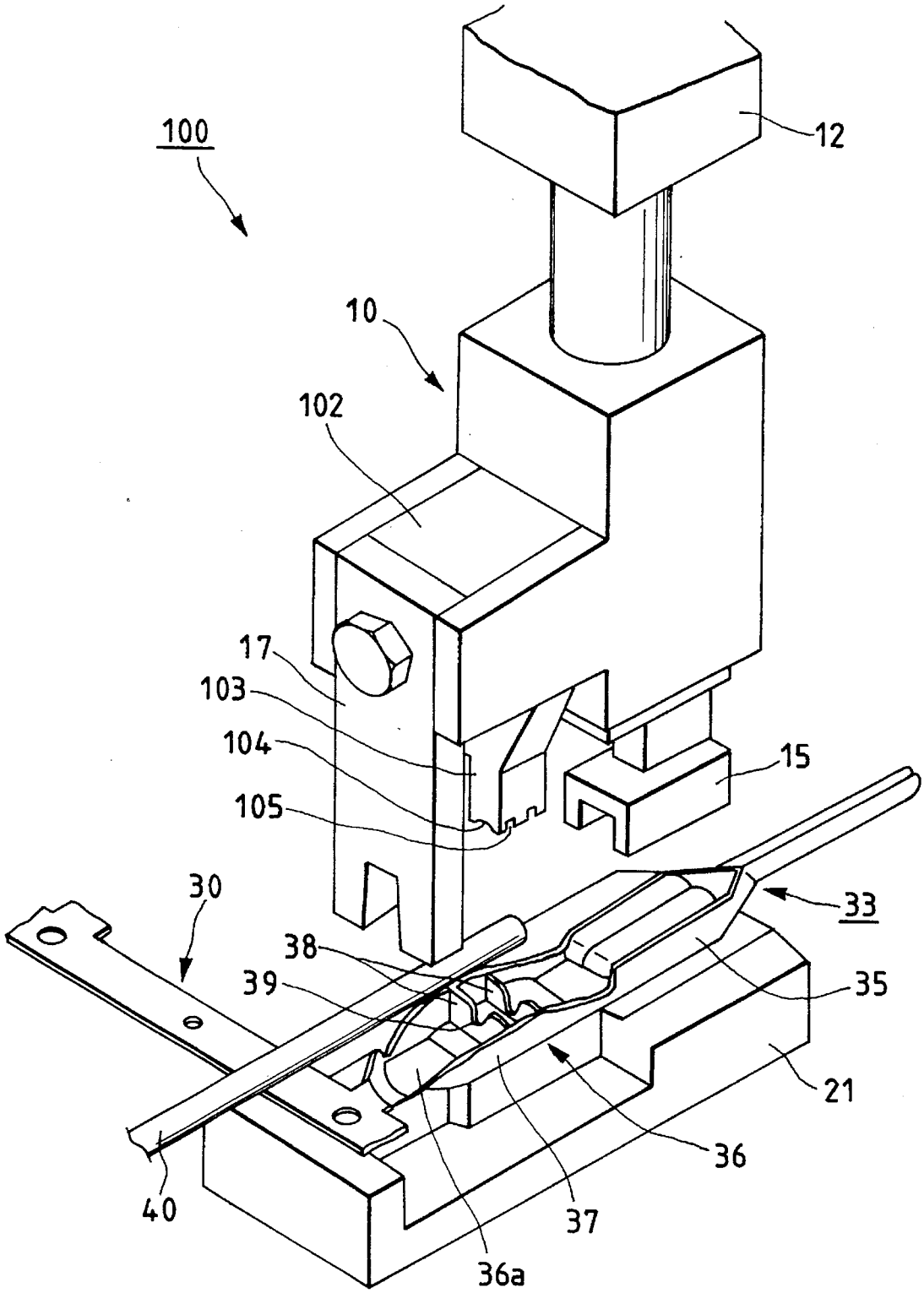
FIG. 11 is a perspective view showing a condition in which a wire is pressed onto a pressure terminal by a Prior Art wire pressing apparatus.
Figure 12:
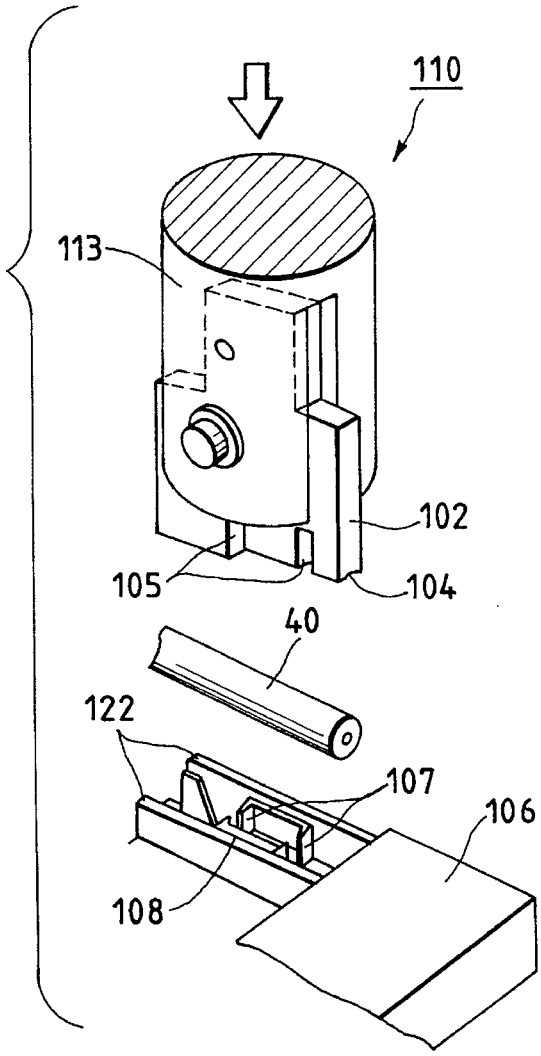
FIG. 12 is a perspective view showing a condition in which a wire is pressed after a pressure terminal is attached to a housing by the Prior Art wire pressing apparatus.
Figure 13:
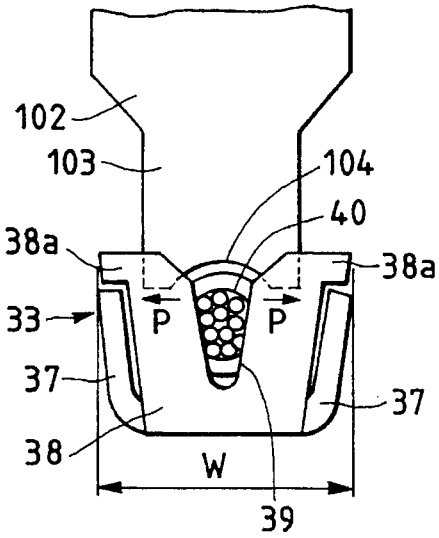
FIG. 13 is a diagram illustrative of an operation in FIG. 11.
Figure 14:
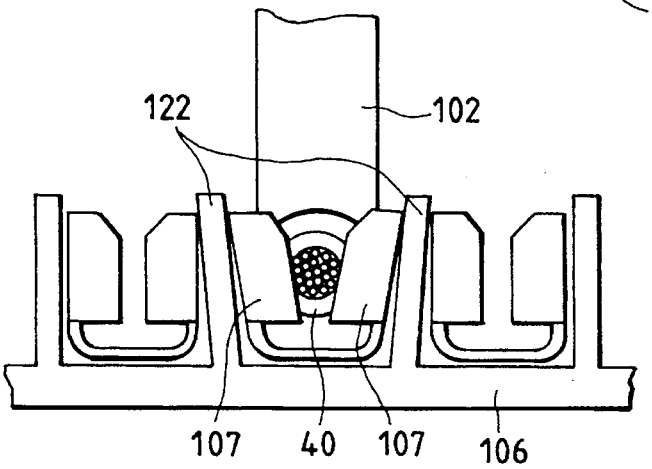
FIG. 14 is a diagram illustrative of an operation in FIG. 12.

A third embodiment of the invention will be described in detail next with reference to FIGS. 7 to 10. FIG. 7 is a partial perspective view of a main portion of a wire pressing apparatus for a pressure terminal, which is a third embodiment of the invention; FIG. 8 is a diagram illustrative of an operation of the wire pressing apparatus shown in FIG. 7 in the form of a condition before pressing a wire; FIG. 9 is a diagram illustrative of an operation of the wire pressing apparatus shown in FIG. 7 in the form of a condition during the pressing of the wire; and FIG. 10 is a diagram illustrative of an operation of the wire pressing apparatus shown in FIG. 7 in the form of a condition after having pressed the wire.

As shown in FIG. 7, the front end of an applicator main body 52 of a wire pressing apparatus 50 is attached from an opening 52*a* thereof arranged on a side wall. The applicator main body 52 includes a pressing punch 51 fixed by a retaining shaft 56 and a pair of movable holding sections 53, 53 that are disposed on both sides of the pressing punch 51 and urged downward by resilient members 54, one end of each resilient member 54 being supported by said main body.

In the lower end of the pressing punch 51 are releasing grooves 51*a* for avoiding interference with the pressing blades 38 and a wire pressing groove 57 that is to be abutted against a wire.

Further, the movable holding sections 53, 53, which are two confronting plate-like bodies, not only move vertically while being in contact with both the inner walls of the applicator main body 52 and the side walls of the pressing punch 51, but also are urged downward by the resilient members 54. These resilient members 54 are, e.g., coil springs, flat springs, resilient rubber bodies, and the like. Further, an engaging groove 55 that engages with the cavity wall 27 of the housing 26 is provided in the lower end of each movable holding section 53.

The operation of pressing the wire 40 onto the pressure terminal 33 will be described next. As shown in FIG. 8, the applicator main body 52 is in a predetermined stand-by position above the wire 40 and the pressing blades 38 together with the pressing punch 51 and the movable holding sections 53, 53 before starting the pressing operation. Upon start of the wire pressing operation under this condition, the applicator main body 52 is lowered so that the lower ends of the movable holding sections 53, 53 suspended by the resilient members 54 are abutted against the upper ends of the cavity walls 27, 27 of the housing 26, thereby engaging the engaging grooves 55 in the lower ends of the respective movable holding sections 53, 53 with the upper ends of the cavity walls 27.

Then, as shown in FIG. 9, when the applicator main body 52 is further lowered, the wire pressing groove 57 in the lower end of the pressing punch 51 is abutted against the wire 40 and presses the wire 40 downward. At this instance, resiliencies are produced due to the resilient members 54 being compressed by the lowering of the applicator main body 52. The movable holding sections 53, 53 come to press the upper ends of the cavity walls 27 strongly by these resiliencies, which further reinforces the engagement between the respective engaging grooves 55 with the cavity walls 27.

Finally, as shown in FIG. 10, the sheathed portion of the wire 40 comes in contact with the pressing blades 38 by the lowering of the pressing punch 51. As the pressing punch 51 is further lowered, the edges of the pressing blades 38 cut the sheathed portion of the wire 40, thereby starting to press fit the wire 40 into the slots 39 of the pressing blades 38. At this instance, large outwardly expanding force is applied to both side portions of each pressing blade 38. That is, the expanding force applied to the pressing blades 38, 38 acts to expand the pressing blades 38 and the side walls 37 toward both cavity walls 27, 27, i.e., in the outward directions.

However, since both cavity walls 27, 27 are engaged with the movable holding sections 53, 53, respectively, such a plastic deformation of both side walls of the pressing blades 38 as to expand outward is blocked by the cavity walls 27. Therefore, the exposed conductors of the wire 40 can be reliably press-fitted into the slots 39 of the pressing blades 38, thereby implementing reliable electric conduction.

As described above, not only the movable holding sections 53, 53 press both cavity walls 27, 27 from above over the entire wire pressing operation, but also the respective engaging grooves 55 are engaged with the upper ends of both cavity walls 27, 27. Therefore, the expansion of the pressing blades 38 and the side walls 37 can be reliably prevented. As a result of this construction, the exposed conductors can be press-fitted deep into the pressing blades 38, thereby implementing highly reliable electric conduction.

It may be noted that the pressing punch 51 according to the third embodiment is formed into a module integrally with the movable holding sections 53, and this allows pressing punches corresponding to specifications of differing standard to be prepared. As a result of this construction, a plurality of types of pressing punches can be used interchangeably on a single wire pressing apparatus, thereby allowing pressure terminals of differing size and specification to be connected by pressure. Hence, not only superfluous equipment investment but also the cost of manufacture can be curtailed.

In addition, the application of the invention is not limited to the aforementioned embodiments. For example, the movable holding section 53 may be designed in any way as long as the movable holding section can prevent the pressing blades and the side walls from being expanded. The engaging groove of the movable holding section may be an engaging projection.

As described above, the wire pressing method and apparatus for a pressure terminal of the invention is characterized as blocking the plastic deformation of the pressing blades by causing a pair of walls arranged on both side portions of the pressing punch to prevent the pressing blades and the side walls from being expanded outward or by causing a pair of movable holding sections to prevent the cavity walls from falling down during the operation of pressing a wire.

Therefore, the reliable prevention of the plastic deformation of the pressing blades leads to the prevention of defective connection and the like attributable to the deformed pressing blades, which in turn allows a highly reliable pressure terminal with a wire connected thereto to be provided.

In addition, the wire pressing method and apparatus for a pressure terminal of the invention is also characterized as forming the pressing punch into a releasable module. This allows pressing punches corresponding to pressure terminals of differing size and specification to be prepared and interchanged whenever necessary.

Therefore, the operation of pressing wires onto a plurality of types of pressure terminals can be performed by a single wire pressing apparatus, thereby contributing to a significant improvement in operability.

Moreover, the wire pressing method and apparatus for a pressure terminal of the invention is further characterized as forming not only the tapered guide surfaces at the front ends of both walls but also the engaging grooves in the lower ends of the movable holding sections to allow a pressure terminal or the housing to be reliably guided to a predetermined position. Therefore, the operability and reliability of the pressing operation can be further improved.

The object of the invention is to provide a wire pressing method and apparatus for a pressure terminal capable not only of establishing electrical conduction between pressure terminals of differing standard and wires but also of preventing pressing blades from being expanded at the time of a pressing operation.

We claim:

1. A method of electrically connecting a wire to a terminal, the wire including a conductor surrounded by an insulator and the terminal including a wire connecting portion having a pair of blades defining a wire receiving groove therebetween, the method comprising the following steps:

placing said terminal on a pedestal;

positioning a movable applicator above the terminal, the applicator including a wire pressing portion and a pair of retaining arms;

placing the wire on the wire connecting portion of the terminal; and moving said applicator downwardly such that said pair of retaining arms sandwich said blades therebetween, and said wire pressing portion Forces said wire into said groove of said terminal, said retaining arms preventing outward movement of said blades in a radial direction of said wire.

2. The method of claim 1, further comprising the step of crimping portions of said terminal around said insulator of said wire.

3. A method of electrically connecting a wire to a terminal while the terminal is received in a terminal receiving chamber of a housing defined by opposing chamber side walls, the wire including a conductor surrounded by an insulator and the terminal including a wire connecting portion having a pair of blades defining a wire receiving groove therebetween, the method comprising the following steps;

placing said terminal on a pedestal;

positioning a movable applicator above the terminal, the applicator including a wire pressing portion and a pair of retaining arms;

placing the wire on the wire connecting portion of the terminal; and moving said applicator downwardly such that said pair of retaining arms respectively retain said chamber side walls and said wire pressing portion forces said wire into said groove of said terminal, said retaining arms preventing outward movement of said chamber side walls in a radial direction of said wire.

4. The method of claim 3, wherein said retaining arms respectively include recessed portions at distal ends thereof and wherein during said moving step, said chamber side walls are respectively received and retained in said recessed portions.

5. The method of claim 3, wherein during said moving step said retaining arms respectively abut against an outer surface of said chamber side walls.

6. A wire pressing apparatus for elastically connecting a terminal to a wire, the wire including a conductor surrounded by an insulator and the terminal including a wire connecting portion having a pair of blades defining a wire receiving groove therebetween, the apparatus comprising:

a vertically movable applicator confronting said terminal and movable with respect to said terminal, said vertically movable applicator including a wire pressing portion disposed on a bottom end thereof for pressing the wire into said groove such that said blades cut the insulator and electrically contact the conductor, and retaining means attached to a lower end of said applicator for preventing outward movement of said blades in a radial direction of said wire when the wire is pressed in said groove.

7. The apparatus of claim 6, wherein said movable applicator further includes an insulator crimper attached to a lower end thereof for crimping said terminal to said insulator of said wire.

8. The apparatus of claim 6, wherein said retaining means comprises a pair of side walls respectively disposed on opposite sides of said wire pressing portion and extending downwardly toward said terminal, said side walls sandwiching said blades therebetween when said wire is pressed into said groove.

9. The apparatus according to claim 8, wherein distal end surfaces of said side walls are tapered to allow said side walls to be positioned outside said blades of said terminal.

10. The apparatus according to claim 6, wherein said wire pressing portion and said retaining means constitute a pressing punch, said pressing punch being detachably secured to said movable applicator.

11. A wire pressing apparatus for electrically connecting a terminal to a wire when said terminal is received in a terminal receiving chamber of a connector housing defined by opposing chamber side walls, the wire including a conductor surrounded by an insulator and the terminal including a wire connecting portion having a pair of blades defining a wire receiving groove therebetween, the apparatus comprising:

a wire pressing portion for pressing the wire into said groove such that said blades cut the insulator and electrically contact the conductor, said wire pressing portion confronting said terminal and being vertically movable with respect to said terminal; and retaining means attached to said wire pressing portion for preventing the chamber side walls of said housing from expanding outwardly in a radial direction of said wire when the wire is pressed in said groove.

12. The wire pressing apparatus of claim 11, wherein said retaining means comprises a pair of spaced apart retaining side walls which respectively abut against outer surfaces of said chamber side walls of said housing when said wire is pressed into said groove.

13. The apparatus of claim 11, wherein said retaining means includes a pair of holding sections each having a recess therein which said chamber side walls of said housing are respectively received when said wire is pressed into said groove.

14. The apparatus of claim 13, wherein said wire pressing portion and said retaining means are connected to a vertically movable applicator.

15. The apparatus of claim 14, wherein said holding sections are movable with respect to said wire pressing portion.

16. The apparatus of claim 15, further comprising a pair of springs attached to said vertically movable applicator for respectively urging said movable holding sections downwardly into engagement with said chamber side walls of said connector housing.

* * * * *